US006362410B1

(12) United States Patent
Kira

(10) Patent No.: US 6,362,410 B1
(45) Date of Patent: Mar. 26, 2002

(54) ELECTRONIC MUSICAL INSTRUMENT

(75) Inventor: Yoshihumi Kira, Hamamatsu (JP)

(73) Assignee: Kabushiki Kaisha Kawai Gakki Seisakusho, Shizuoka-Ken (JP)

( * ) Notice: Subject to any disclaimer, the term of this patent is extended or adjusted under 35 U.S.C. 154(b) by 0 days.

(21) Appl. No.: 09/670,887

(22) Filed: Sep. 28, 2000

(30) Foreign Application Priority Data

Sep. 28, 1999 (JP) ..... 11-274999
Oct. 26, 1999 (JP) ..... 11-304407
Oct. 26, 1999 (JP) ..... 11-304408

(51) Int. Cl.[7] ..... G10H 1/053; G10H 1/22; G10H 1/46

(52) U.S. Cl. ..... 84/618; 84/626; 84/633; 84/DIG. 2

(58) Field of Search ..... 84/615, 618, 626–633, 84/DIG. 2

(56) References Cited

U.S. PATENT DOCUMENTS 5,009,147 A * 4/1991 Yamamori ..... 84/618
5,159,144 A * 10/1992 Fujisawa ..... 84/DIG. 2
5,315,059 A * 5/1994 Saito ..... 84/DIG. 2

FOREIGN PATENT DOCUMENTS

JP 2-15078 4/1990

* cited by examiner

*Primary Examiner*—Stanley J. Witkowski
(74) *Attorney, Agent, or Firm*—Christie, Parker & Hale, LLP

(57) ABSTRACT

An electronic musical instrument having a single-tone priority function includes touch detection value storage means for storing a touch detection value that pertains to an ON key, priority key selection means for selecting the first priority key out of ON keys when detecting a key OFF event, tone generation means for generating a tone corresponding to the first priority key selected by the priority key selection means, tone volume computation means for computing a tone volume of the tone generated by the tone generation means on the basis of a touch detection value that pertains to the priority key stored in the touch detection value storage means, and a touch detection value that pertains to the latest key event, and tone generation control means for controlling to generate the tone in the tone volume computed by the tone volume computation means, thereby allowing a legato play with a natural tone volume with respect to a play made so far.

18 Claims, 7 Drawing Sheets

ELECTRONIC MUSICAL INSTRUMENT

BACKGROUND OF THE INVENTION

The present invention relates to electronic musical instruments, tone generation control methods, and storage media, particularly to electronic musical instruments having a single-tone priority function (hereinafter referred to as solo function).

Conventionally known are electronic musical instruments that have a single-tone priority function (a function of controlling to generate a single tone only; so-called solo function). In such electronic musical instruments, it is known to select a priority key out of all other keys that were being depressed at the time of detecting a key OFF event, and re-generate the tone corresponding to the key (hereinafter referred to as re-trigger).

In re-triggering upon a key OFF event in legato play using such a single-tone priority function, the next tone is generated based on the touch detection value of the key the tone of which has been generated, as disclosed in, e.g., Japanese Patent Publication No. 2-15078 (1990).

That is, in legato play using the convention single-tone priority function, old data is erased every time a new touch detection value is taken in, and the touch detection signal of the key whose depression start timing is the latest among the keys selected as priority keys is stored in a storage means. Processing for re-triggering is done based on the latest key touch detection signal stored in the storage means, to control the volume of the next tone to be generated.

In the tone-generating method used in such a conventional electronic musical instrument, however, when a player likes to play with generating tones by selectively using weak and strong touches to obtain a delicate nuance, it often results in a play with an unnatural feeling.

However, for example, when the player wants to emphasize only one tone in a continuous play with weak touches, he or she strongly attacks the key for the tone to be emphasized. Accordingly, in such a case, since re-triggering executed upon a key OFF event in the conventional electronic musical instrument is also done to generate a tone based on the strong touch tone detection value, there is the problem that the next tone is generated to be undesirably loud.

Therefore, re-triggering with the velocity value of the tone that has been generated, does not always bring about a smooth play, and there is the case that re-triggering with a certain velocity value results in a play with an unnatural feeling.

SUMMARY OF THE INVENTION

In view of the above problems, the present invention aims to realize more natural and preferable legato play with re-triggered tones.

According to an aspect of the present invention, there is provided an electronic musical instrument having a single-tone priority function. The instrument comprises touch detection value storage means for detecting the touch in relation to a depressed key and storing the value; priority key selection means for selecting the first priority key out of the keys that were being depressed when a key the tone of which has been generated is released; tone generation means for generating the tone corresponding to the first priority key selected by said priority key selection means; tone volume computation means for computing the volume of a tone to be generated by said tone generation means on the basis of the touch detection value in relation to the priority key stored in said touch detection value storage means, and the touch detection value in relation to the latest key; and tone generation control means for controlling to generate a tone with the volume computed by said tone volume computation means.

Besides, another feature of the electronic musical instrument is characterized in that said tone volume computation means computes said tone generation volume with the average value of the latest touch detection value and the touch detection value in relation to the priority key stored in said touch detection value storage means.

Besides, another feature of the electronic musical instrument is characterized in that said tone volume computation means does not use a touch detection value larger than a predetermined tone volume value, as data for computing said tone generation volume.

According to another aspect of the present invention, there is provided a tone generation control method in an electronic musical instrument having a single-tone priority function. The method generates a re-triggered tone upon a key release, by executing a storage process of detecting the touch in relation to a depressed key and storing the value in touch detection value storage means; a priority key selection process of selecting the first priority key out of the keys that were being depressed when a key the tone of which has been generated is released; a tone generation process of generating, from tone generation means, the tone corresponding to the first priority key selected by said priority key selection process; a tone volume computation process of computing the volume of a tone to be generated in said tone generation means, on the basis of the touch detection value in relation to the priority key stored in said touch detection value storage means, and the touch detection value in relation to the latest key; and a tone generation control process of controlling to generate a tone with the volume computed by said tone volume computation process.

According to still another aspect of the present invention, there is provided a storage medium storing a program that causes a computer to function as the respective means making up the above electronic musical instrument.

Besides, another feature of the storage medium is characterized by storing a program for causing a computer to execute procedures of a method of controlling the above electronic musical instrument.

Every time a key is depressed, a new touch is detected and its value is stored in the touch data storage means in order, and a tone volume control of the next tone to be generated is made using the touch data stored in the above storage means. By this manner, a tone can be generated with a velocity value that causes a less unnatural feeling in the flow of play, while being influenced by the strength of the tone that has been generated. Thus satisfactory legato play using the solo function can be performed.

DETAILED DESCRIPTION

Hereinafter, electronic musical instruments, tone generation control methods, and storage media according to embodiments of the present invention will be described with reference to the accompanying drawings.

(First Embodiment)

Figure 1:
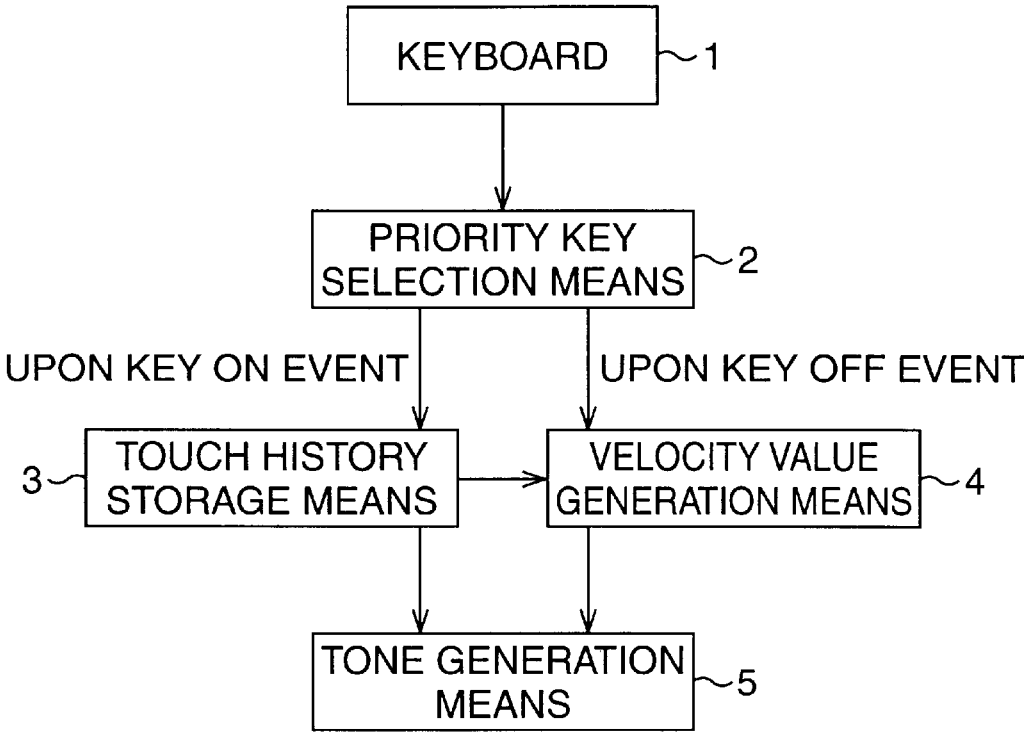
FIG. 1 shows the first embodiment of the present invention and is a block diagram showing a schematic construction of a legato play function.

As shown in the block diagram of FIG. 1, an electronic musical instrument of the first embodiment of the present invention comprises a keyboard 1, priority selection means 2, touch history storage means 3, velocity value generation means 4, and tone generation means 5.

The keyboard 1 comprises keys (FIG. 3) for generating tones, and key switches are provided corresponding to the respective keys.

The priority selection means 2 is a means that preferentially selects only a single ON key, and the key selected by this priority selection means 2 is stored in the touch history storage means 3 upon a key ON event. When the above priority key is made OFF, it is stored in the velocity value generation means 4.

The tone generation means 5 generates a tone of the key stored in the touch history storage means 3, and executes processing of tone generation for a key selected out of the keys that were being depressed when a key OFF event occurs. At this time, in this embodiment, by performing the tone generation with a volume with taking the strength of the tone that has been generated, into consideration, legato play using a solo function can be performed with a velocity value that does not cause an unnatural feeling in the flow of play.

Next, a processing procedure in the electronic musical instrument according to this embodiment will be described in detail with reference to the flowchart of FIG. 2.

Figure 2:
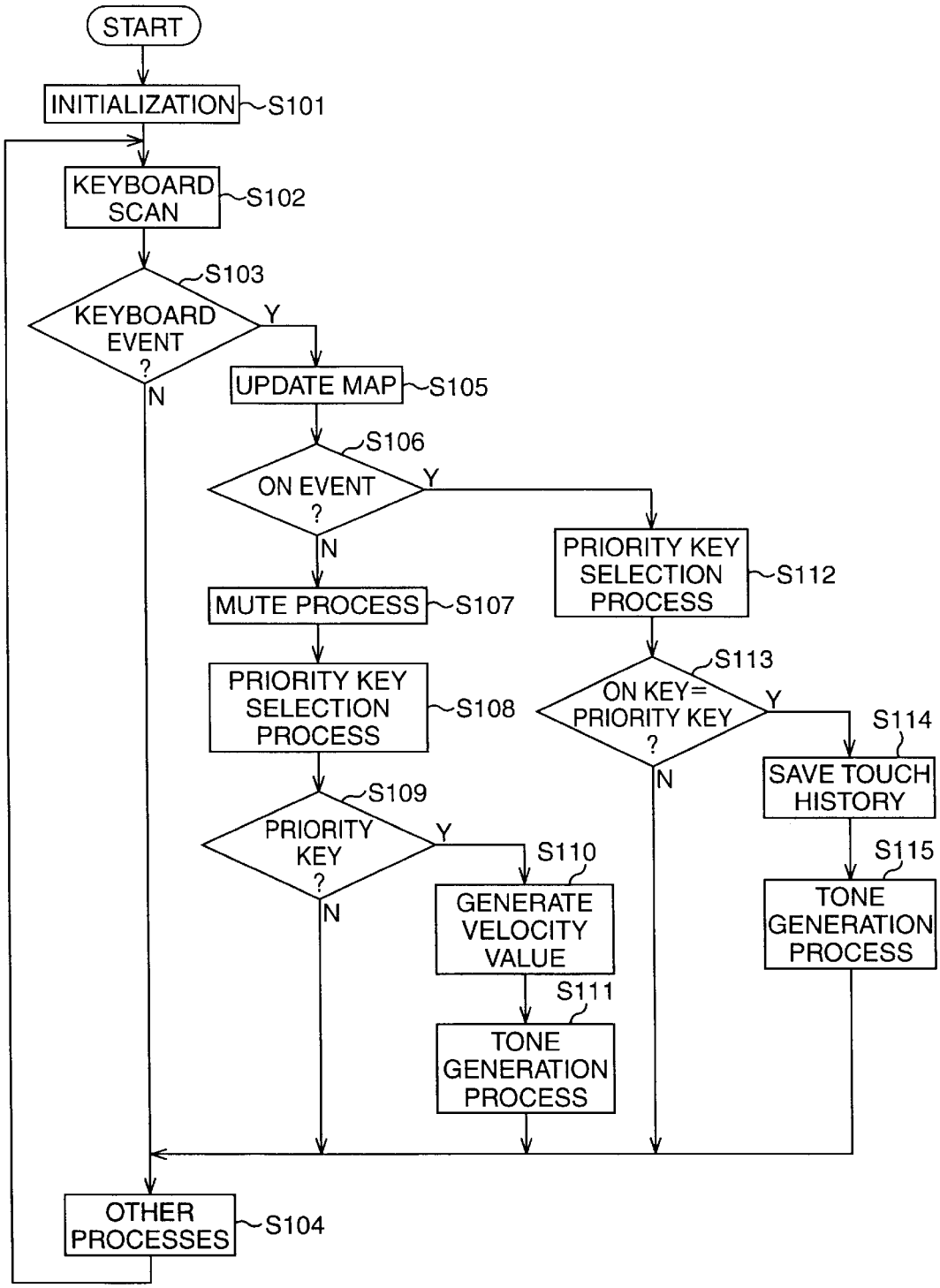
FIG. 2 is a flowchart for explaining details of the tone volume control procedure executed by an electronic musical instrument according to the first embodiment.

As shown in FIG. 2, when processing is started, the storage means that stores data is initialized in the first step S101.

Next, the flow advances to step S102, in which a scan process for the keyboard 1 is executed. As a result of this scan process, it is judged in step S103 whether or not there is a keyboard event. As a result of this judgment, if there is no keyboard event, the flow advances to step S104, in which other processes are executed. After this, the flow returns to step S102 to repeat the aforementioned processes.

On the other hand, as a result of the judgment in step S103, if there is a keyboard event, the flow advances to step S105, in which a map update process is executed. The flow then advances to step S106, in which it is judged whether or not the above keyboard event is an ON event. As a result of this judgment, if the above keyboard event is not an ON event, since the keyboard event is an OFF event, the flow advances to step S107, in which a mute process for the key corresponding to the OFF event is executed.

Next, the flow advances to step S108, in which a priority key selection process is executed. This priority key selection process is for, when there are ON keys upon occurrence of the OFF event, selecting a priority key out of the above ON keys, as described above. After completion of the priority key selection process, the flow then advances to step S109, in which it is judged whether or not there is a priority key. As a result of this judgment, if there is no priority key, the flow advances to step S104, in which the above-described other processes are executed. After this, the flow returns to step S102.

On the other hand, as a result of the judgment in step S109, if there is a priority key, the flow advances to step S110, in which a velocity value VELO is generated. This velocity value generation process is done by the aforementioned velocity value generation means 4 using the following expression. That is, $$VELO= (A0.V0+A1.V1 \ldots +An\ Vn)/(A0+\ldots +An)$$

V: touch detection history data

A: weight depending on the detection timing

After the velocity value is generated as described above, the flow advances to step S111, in which a tone generation process at the time of re-triggering is executed using the above generated velocity value. In this manner, by executing the tone generation process, legato play using the solo function can be performed with a velocity value that does not cause an unnatural feeling in the flow of play, while reflecting the strength of the tone that has been generated.

On the other hand, as a result of the judgment in step S106, if the keyboard event is an ON event, the flow advances from step S106 to step S112, in which a priority key selection process is executed. After completion of this process, the flow advances to step S113, in which it is judged whether or not the ON key is the priority key. As a result of this judgment, if the ON key is not the priority key, the flow advances to step S104 to repeat the aforementioned processes.

On the other hand, as a result of the judgment in step S113, if the ON key is the priority key, the flow advances to step S114, in which the touch history is kept in the touch history storage means 3 to prepare for the case that the tone of the priority key is generated later. After this, the flow advances to step S115, in which a tone generation process upon the ON key event is executed. That is, the tone corresponding to the ON key is generated with a volume based on the touch detection value upon the key ON event.

Figure 3:
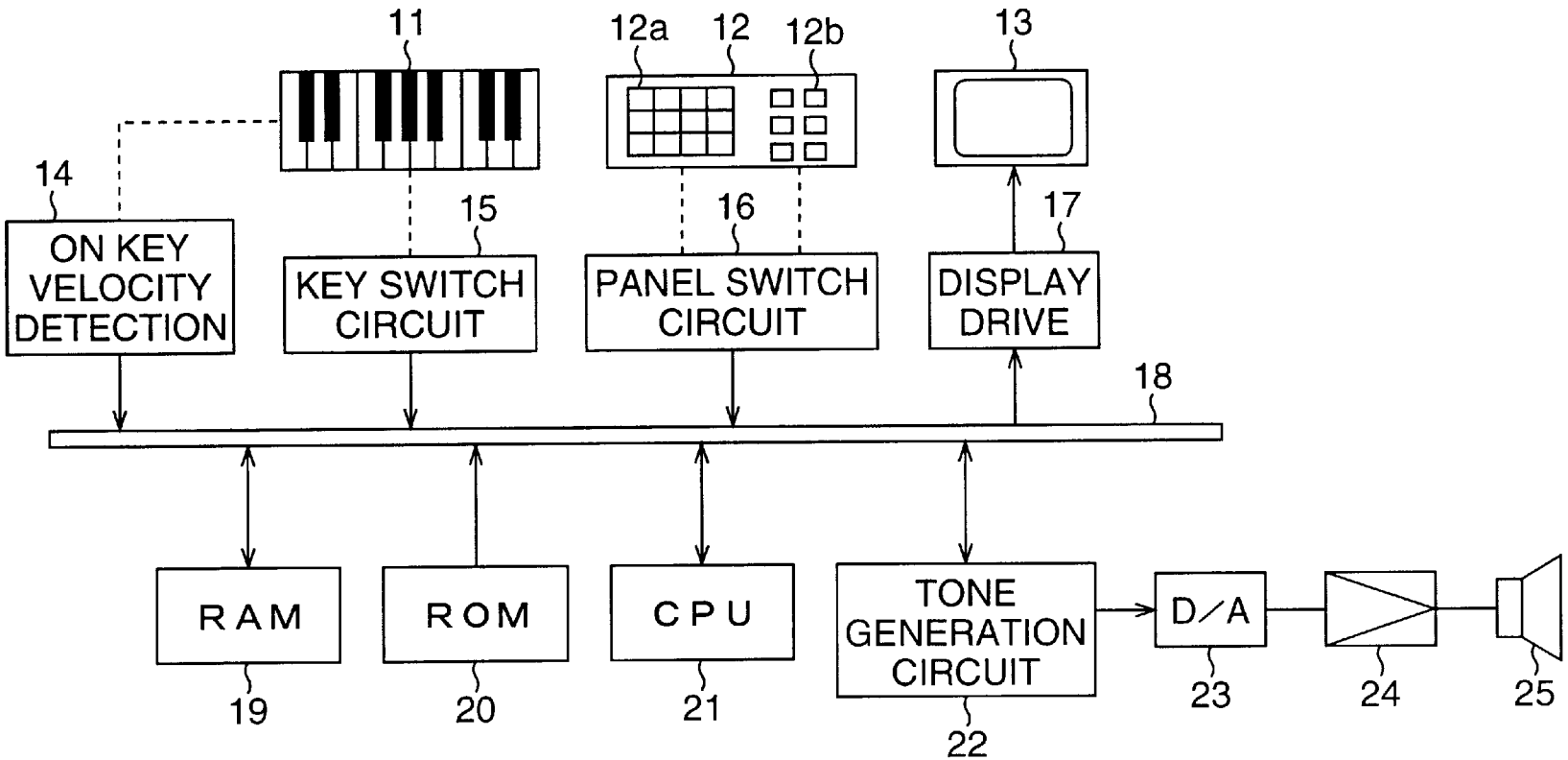
FIG. 3 is a block diagram showing a specific example of construction of the electronic musical instrument.

FIG. 3 is a block diagram showing the construction of a principal part of the electronic musical instrument of this embodiment. This electronic musical instrument comprises a keyboard 11, an operation panel 12, a display device 13, a key ON velocity detection circuit 14, etc.

The circuit section of the electronic musical instrument comprises a microcomputer made up from a CPU 21, a ROM 20, and a RAM 19 connected to one another through a bus 18. The CPU 21 detects operation information on the keyboard 11 from a key switch circuit 15 connected to the keyboard 11, and detects operation information on a panel switch from a panel switch circuit 16 connected to the operation panel 12.

The operation panel 12 is provided with ten-key switches 12*a*, and select buttons 12*b* for selecting modes such as rhythm accompaniment, auto-chord play, ad-lib phase play, etc. A type of rhythm or instrument selected by operating the operation panel 12, is displayed on the basis of display data given from the CPU 21 to the display device 13 via a display drive circuit 17.

The CPU 21 sends note information corresponding to keyboard operation, and parameter information on rhythm, tone color, etc., corresponding to panel switch operation, to the tone generation circuit 22. The tone generation circuit 22 reads out PCM sound source data from a waveform memory in the ROM 20 on the basis of these pieces of information, processes the amplitude and the envelope, and outputs them to a D/A converter 23. A tone signal that has been digital/analogue converted by the D/A converter 23, is given to a loudspeaker 25 via an amplifier 24.

A program of a computer that comprises the RAM 19, the ROM 20, and the CPU 21, implements the touch detection value storage means, the priority key selection means, the tone volume computation means, the tone generation control means, etc., of this embodiment.

A touch detection value for generating a tone volume louder than a predetermined tone volume value, is preferably not used as tone volume computation data when generating the tone of the priority key. By this manner, even after one note is played with an especially loud volume, legato play without an unnatural feeling can be realized.

In the electronic musical instrument of this embodiment, as described above, touch detection values are sequentially detected and stored in the touch data storage means, a re-triggering process is executed on the basis of the touch detection values stored in the above storage means, and the latest touch detection value, and the volume of the next tone to be generated corresponding to the key selected as the priority key, is controlled. Hence, the tone can be generated with a velocity value that causes a less unnatural feeling in the flow of play, while being influenced by the strength of the tone that has been generated. Thus satisfactory legato play using the solo function can be performed.

Besides, since the touch detection value for generating a tone volume louder than a predetermined tone volume value, is not used as tone volume computation data when generating the tone of the priority key, even after one note is played with a specially loud tone volume, legato play without an unnatural feeling can be realized.

(Second Embodiment)

Figure 4:
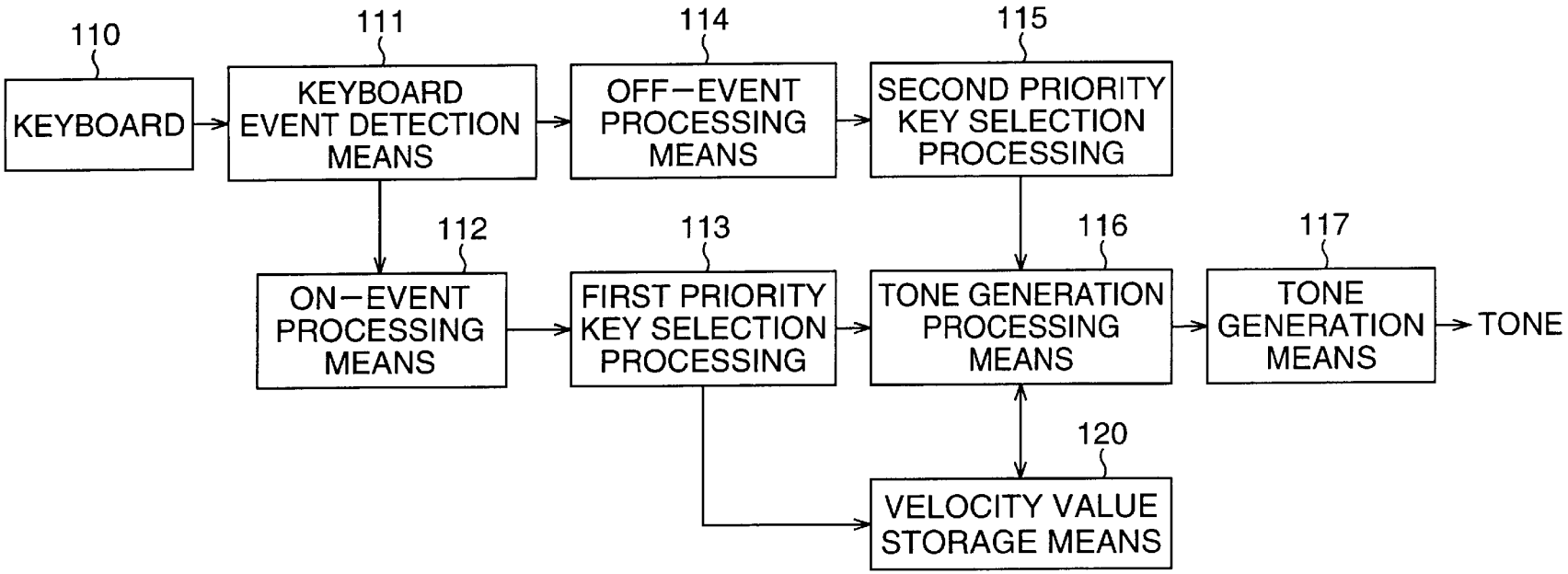
FIG. 4 shows the second embodiment of the present invention and is a block diagram showing a schematic construction of a function for performing legato play.

As shown in the block diagram of FIG. 4, an electronic musical instrument according to the second embodiment of the present invention comprises a keyboard 110, keyboard event detection means 111, ON- event processing means 112, first priority key processing means 113, OFF-event processing means 114, second priority key processing means 115, tone generation processing means 116, tone generation means 117, velocity value storage means 120, etc.

The above keyboard event detection means 111 detects whether or not an operation of a key provided in a piano has been performed. A drive detection sensor (not shown) is so disposed as to correspond to each key. Presence/absence of a key operation is judged with a detection output of the above sensor.

The detection output of the above keyboard event detection means 111 is given to either the ON-event detection means 112 or the OFF-event detection means 114.

The ON-event processing means 112 operates when a keyboard event detected by the above keyboard event detection means 111 is an ON event, and performs map processing in relation to the keyboard event.

The first priority key processing means 113 performs processing in relation to the priority key selected by the ON-event processing means 112. It determines whether or not the ON key is the priority key. If the above ON key is the priority key, it makes the tone generation processing means 116 operate to perform processing for generating the tone corresponding to the ON key, with the velocity value (touch detection value) of the ON key. Also, it stores the velocity value of the key corresponding to the above ON event, in the above velocity value storage means 120.

The OFF-event processing means 114 operates when a keyboard event detected by the keyboard event detection means 111 is an OFF event, and performs mute processing in relation to the key the tone of which has been generated.

The second priority key processing means 115 selects a priority key out of the keys that were being depressed upon the above OFF event. If there is a priority key, it conducts instructions to make the tone generation processing means 116 perform tone generation processing.

The tone generation processing means 116 performs tone generation processing on the basis of instructions by the first priority key processing means 113 or second priority key processing means 115, generates a tone with the volume corresponding to a velocity value recorded in the velocity value storage means 120, and conducts it out to the tone generation means 117. The tone generation means 117 generates a tone based on tone data input from the tone generation processing means 116.

Next, a tone generation control method in the electronic musical instrument according to this embodiment will be described in detail with reference to the flowchart of FIG. 5.

Figure 5:
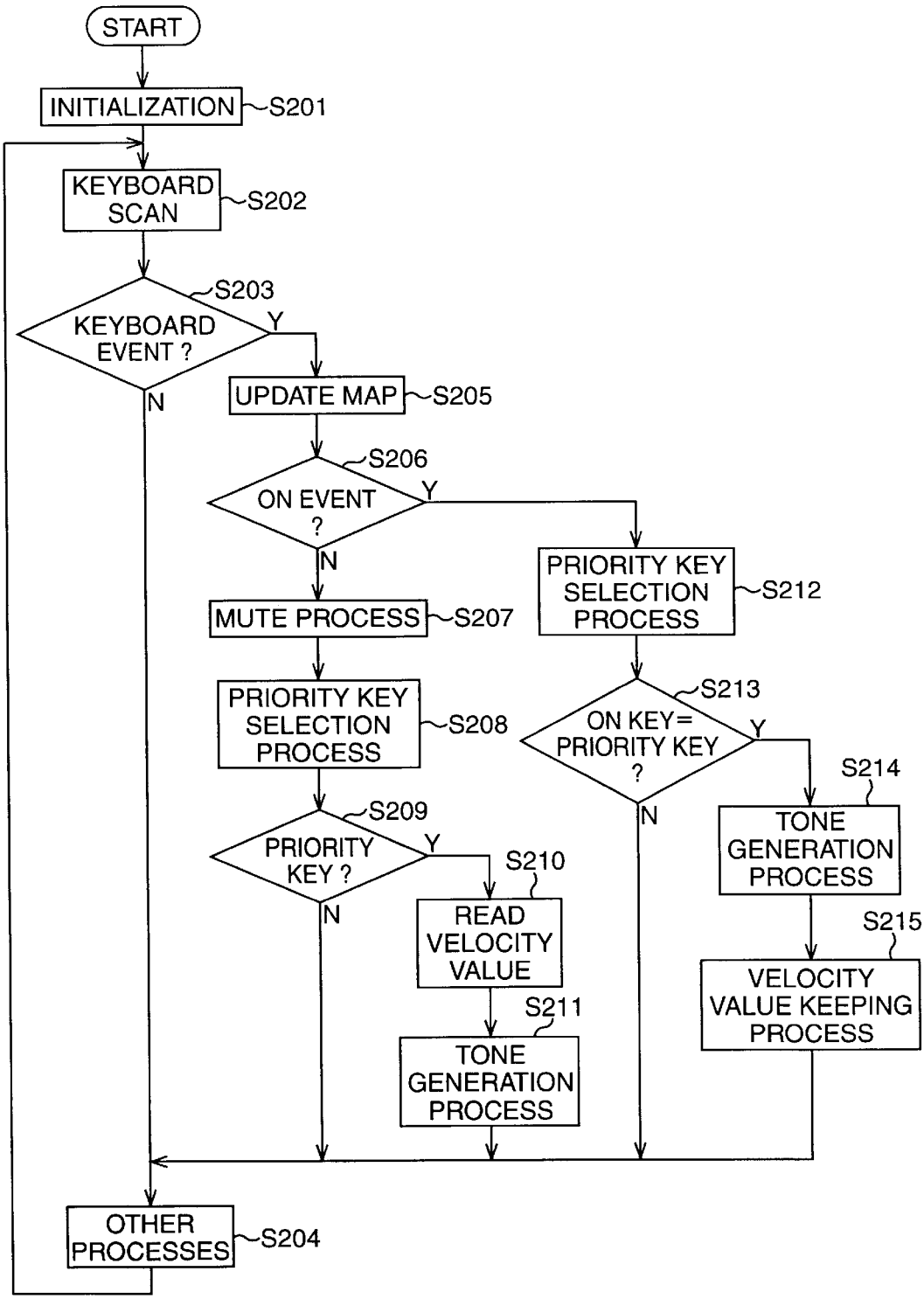
FIG. 5 is a flowchart for explaining details of the tone volume control procedure executed by an electronic musical instrument according to the second embodiment.

As shown in FIG. 5, when processing is started, the storage means that stores data is initialized in the first step S201.

Next, the flow advances to step S202, in which a scan process for the keyboard ii0 is executed. As a result of this scan process, it is judged in step S203 whether or not there is a keyboard event. As a result of this judgment, if there is no keyboard event, the flow advances to step S204, in which other processes are executed. After this, the flow returns to step S202 to repeat the aforementioned processes.

On the other hand, as a result of the judgment in step S203, if there is a keyboard event, the flow advances to step S205, in which a map update process is executed. The flow then advances to step S206, in which it is judged whether or not the above keyboard event is an ON event. As a result of this judgment, if the above keyboard event is not an ON event, since the keyboard event is an OFF event, the flow advances to step S207, in which a mute process for the key corresponding to the OFF event is executed.

Next, the flow advances to step S208, in which a priority key selection process is executed. This priority key selection process is for, when there are ON keys upon occurrence of the OFF event, selecting a priority key out of the ON keys, as described above.

After completion of the priority key selection process, the flow then advances to step S209, in which it is judged whether or not there is a priority key. As a result of this judgment, if there is no priority key, the flow advances to the above-described step S204, in which other processes are executed. After this, the flow returns to step S202.

On the other hand, as a result of the judgment in step S209, if there is a priority key, the flow advances to step S210, in which a velocity value stored in the velocity value storage means 120 is read out. In this embodiment, the velocity value upon depression of the priority key to be re-triggered is read out from the velocity value storage means 120.

After the velocity value is read out as described above, the flow advances to step S211, in which a tone generation process at the time of re-triggering is executed using the read velocity value. In this manner, by executing the tone generation process, in the electronic musical instrument of this embodiment, legato play using the solo function can be performed upon an OFF event with a velocity value that does not cause an unnatural feeling in the flow of play, while reflecting the strength of the tone that has been generated.

On the other hand, as a result of the judgment in step S206, if the keyboard event is an ON event, the flow advances from step S206 to step S212, in which a priority key selection process in the ON event is executed. After completion of this process, the flow advances to step S213, in which it is judged whether or not the ON key is the priority key. If the key corresponding to the above ON event is not the priority key, the flow advances to step S204 to repeat the aforementioned processes.

On the other hand, as a result of the judgment in step S213, if the above ON key is the priority key, the flow advances to step S214, in which a tone generation process upon the key ON event is executed. This tone generation process is executed using the velocity value of the key corresponding to the above ON event.

After completion of the tone generation process upon the key ON event in the above step S214, the flow then advances to step S215, in which processing for keeping the velocity value upon the above first key ON event in the velocity value storage means 120, is executed.

Like the first embodiment, FIG. 3 shows the construction of a principal part of the electronic musical instrument of this embodiment. This electronic musical instrument comprises a keyboard II, an operation panel 12, a display device 13, a key ON velocity detection circuit 14, etc.

Also, the circuit section of the electronic musical instrument comprises a microcomputer made up from a CPU 21, a ROM 20, and a RAM 19 connected to one another through a bus 18. The CPU 21 detects operation information on the keyboard 11 from a key switch circuit 15 connected to the keyboard 11, and detects operation information on a panel switch from a panel switch circuit 16 connected to the operation panel 12.

The operation panel 12 is provided with ten-key switches 12*a,* and select buttons 12*b* for selecting modes such as rhythm accompaniment, auto-chord play, ad-lib phrase play, etc. A type of rhythm or instrument selected by operating the operation panel 12, is displayed on the basis of display data given from the CPU 21 to the display device 13 via a display drive circuit 17.

The CPU 21 sends note information corresponding to keyboard operation, and parameter information on rhythm, tone color, etc., corresponding to panel switch operation, to the tone generation circuit 22. The tone generation circuit 22 reads out PCM sound source data from a waveform memory in the ROM 20 on the basis of these pieces of information, processes the amplitude and the envelope, and outputs them to a D/A converter 23. A tone signal that has been digital/analogue-converted by the D/A converter 23, is given to a loudspeaker 25 via an amplifier 24.

A program of a computer that comprises the RAM 19, the ROM 20, and the CPU 21, implements the ON-event processing means 112, the first priority key processing means 113, the OFF-event processing means 114, the second priority key processing means 115, the tone generation processing means 116, etc., of this embodiment.

The present invention can apply to a system made up from two or more devices, or an apparatus consisting of a single device.

Besides, the present invention also includes implementation in which, in order to make various devices operate so as to realize the functions of the above-described embodiment, to an apparatus connected to the above various devices or a computer in a system, a program code of software for realizing the functions of the above embodiment is supplied, and the above devices are made to operate in accordance with a program stored in a computer (CPU or MPU) in the system or apparatus.

Besides, in this case, the program code of the above software itself realizes the functions of the above-described embodiment. The program code itself, and means for supplying the program code to the computer, e.g., a storage medium storing the above program code, constitute the present invention. As the storage medium storing the program code, usable are, e.g., a floppy disk, a hard disk, an optical disk, an optical magnetic disk, a CD-ROM, a magnetic tape, a nonvolatile memory card, a ROM, etc.

Also, not only the explained functions in the above-described embodiment are able to be realized by a computer executing a supplied program code, but also the functions shown in the above-described embodiment are realized by the program code cooperating with the OS (operating system) operating in the computer, or another application software or the like, that program code is included in the embodiment of the present invention.

Further, in case that the supplied program code is stored in a memory provided in a function extension board of the computer or a function extension unit connected to the computer, then the CPU or the like provided in the function extension board or the function extension unit executes part or all of the actual processes on the basis of instructions by the program code, and the functions of the above-described embodiment are realized by the processes, this is included in the present invention.

In the electronic musical instrument of this embodiment, as described above, according to the present invention, the average value of the detection means detecting a velocity value upon an ON event, a new velocity value detected by the above detection means, and the velocity value of the last time stored in the storage means, is obtained, a re-triggering process is executed using the above average value, and the volume of the next tone to be generated corresponding to the key selected as the priority key, is controlled. Hence, the tone can be generated with a velocity value that causes a less unnatural feeling in the flow of play, while being influenced by the strength of the tone that has been generated. Thus satisfactory legato play using the solo function can be performed.

Besides, since the touch detection value for generating a tone volume louder or too less than a predetermined tone volume value, is not used as tone volume computation data when generating the tone of the priority key, even after one note is played with a volume different from a normal play, legato play without an unnatural feeling can be realized.

(Third Embodiment)

Figure 6:
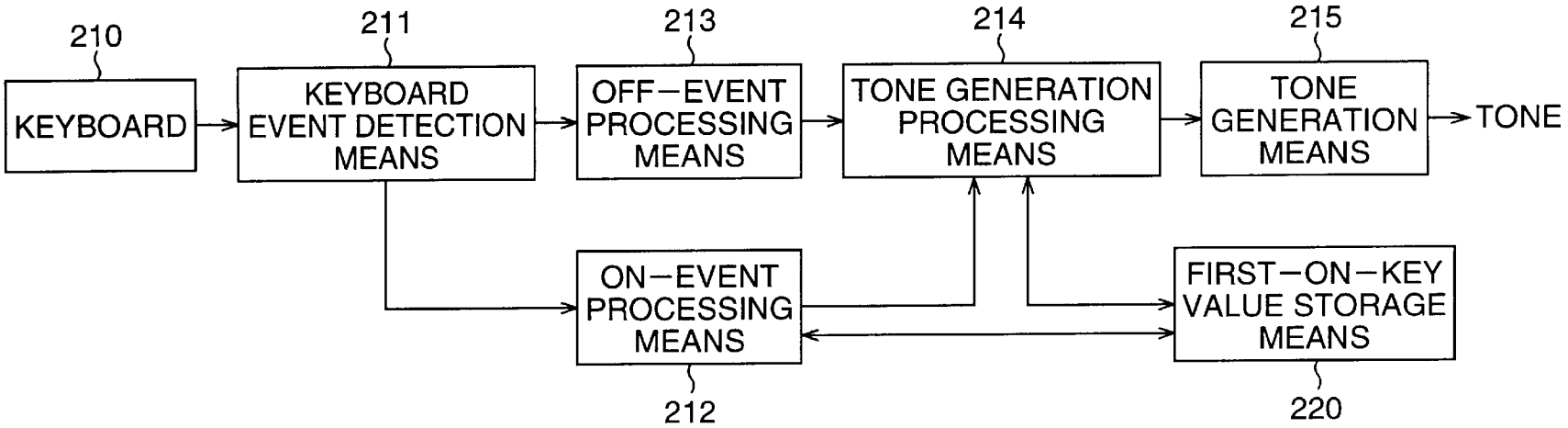
FIG. 6 shows the third embodiment of the present invention and is a block diagram showing a schematic construction of a function for performing legato play.

As shown in the block diagram of FIG. 6, an electronic musical instrument according to the third embodiment of the present invention comprises a keyboard 210, keyboard event detection means 211, ON-event processing means 212, OFF-event processing means 213, tone generation processing means 214, tone generation means 215, first-ON-key value storage means 220, etc.

The above keyboard event detection means 211 is for making a detection as to whether or not an operation of a key provided in a piano has been done. A drive detection sensor (not shown) is so disposed as to correspond to each key. Presence/absence of a key operation is judged with a detection output of the above sensor. If there is a keyboard event, map processing in relation to the keyboard event is performed.

The detection output of the keyboard event detection means 211 is given to either the ON-event detection means 212 or the OFF-event detection means 213. The ON-event processing means 212 operates when the keyboard event detected by the keyboard event detection means 211 is an ON event, and judges as to whether or not the ON key is the priority key.

As a result of the above judgment, if the above ON key is the priority key, it makes the tone generation processing means 214 operate to perform processing for generating the tone corresponding to the ON key, with the velocity value of the above ON key. Also, it performs processing for storing the velocity value of the first ON key detected by the above keyboard event detection means 211, in the first-ON-key value storage means 220.

The OFF-event processing means 213 operates when a keyboard event detected by the keyboard event detection means 211 is an OFF event, and performs mute processing in relation to the key the tone of which has been generated.

Next, it performs a priority key selection process to select a priority key out of the keys that were being depressed upon the above OFF event. As a result of this process, if there is the priority key to be re-triggered for tone generation, it makes instructions for the above tone generation processing means 214 to re-trigger for tone generation in relation to the key.

Next, it performs a priority key selection process, which is a process to select a priority key out of the keys that were being depressed upon the above OFF event. If there is the priority key, it makes instructions for the above tone generation processing means 214 to re-trigger for tone generation in relation to the key.

The above tone generation processing means 214 performs tone generation processing on the basis of instructions by the ON-event processing means 212 and OFF-event processing means 213, generates a tone with the volume corresponding to a velocity value recorded in the first-ON-key value storage means 220, and conducts it out to the tone generation means 215. The tone generation means 215 generates a tone based on tone data input from the tone generation processing means 214.

Next, a tone generation control method in the electronic musical instrument according to this embodiment will be described in detail with reference to the flowchart of FIG. 7.

Figure 7:
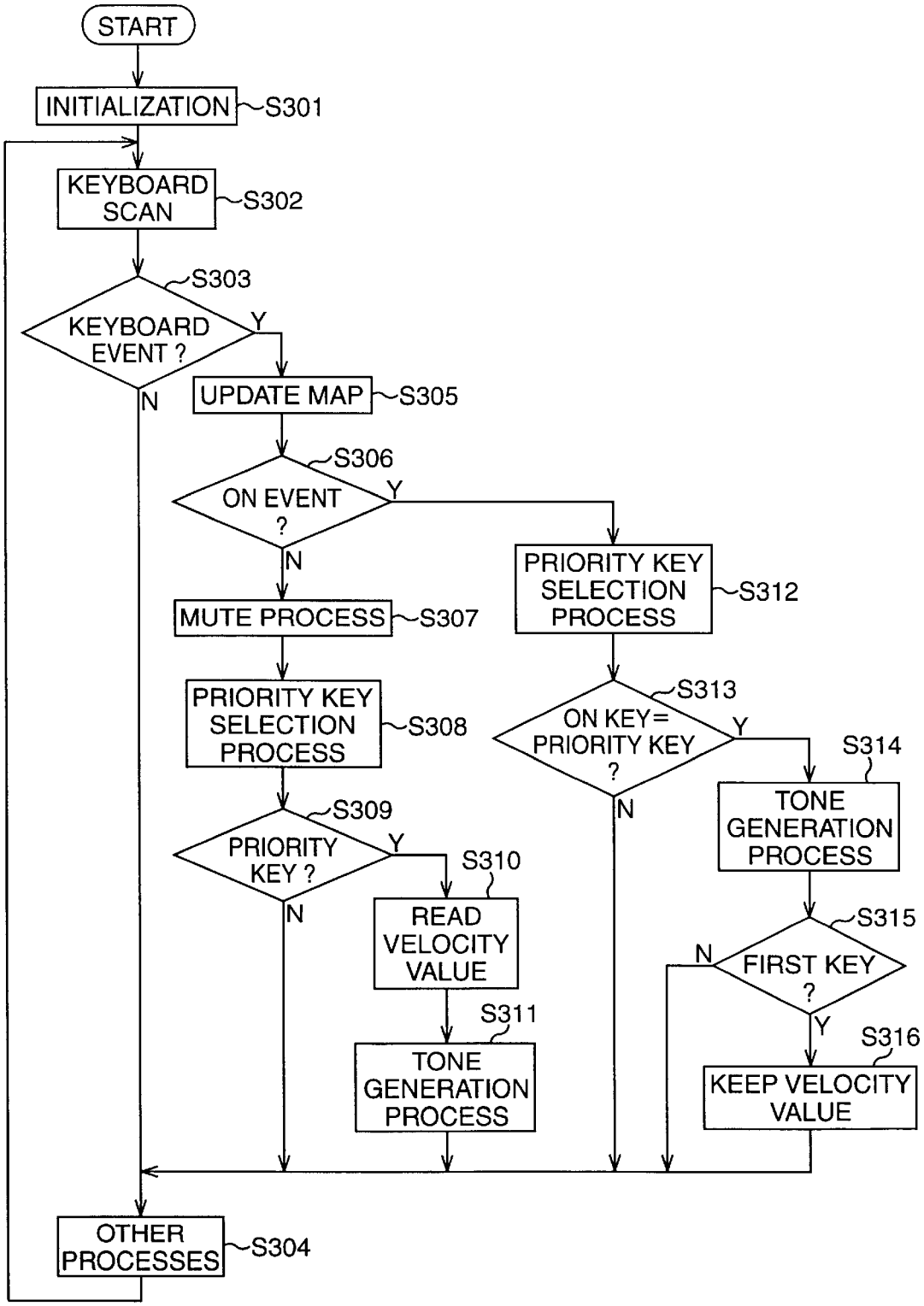
FIG. 7 is a flowchart for explaining details of the tone volume control procedure executed by an electronic musical instrument according to the third embodiment.

As shown in FIG. 7, when processing is started, the storage means that stores data is initialized in the first step S301.

Next, the flow advances to step S302, in which a scan process for the keyboard 210 is executed, As a result of this scan process, it is judged in step S303 whether or not there is a keyboard event in the state that all keys had been OFF. As a result of this judgment, If there is no keyboard event, the flow advances to step S304, in which other processes are executed. After this, the flow returns to step S302 to repeat the aforementioned processes.

On the other hand, as a result of the judgment in step S303, if there is a keyboard event, the flow advances to step S305, in which a map update process is executed. The flow then advances to step S306, in which it is judged whether or not the keyboard event is an ON event. As a result of this judgment, if the keyboard event is not an ON event, since the keyboard event is an OFF event, the flow advances to step S307, in which a mute process for the key corresponding to the OFF event is executed.

Next, the flow advances to step S308, in which a priority key selection process is executed. This priority key selection process is for, when there are ON keys upon occurrence of the OFF event, selecting a priority key out of the above ON keys. After completion of the priority key selection process, the flow then advances to step S309, in which it is judged whether or not there is a priority key. As a result of this judgment, if there is no priority key, the flow advances to the above-described step S304, in which other processes are executed. After this, the flow returns to step S302.

On the other hand, as a result of the judgment in step S309, if there is a priority key, the flow advances to step S310, in which the velocity value upon the first key ON event stored in the first-ON-key value storage means 220 is read out. In this embodiment, the velocity value upon the first key ON event in the state that all keys had been OFF, is read out from the above first-ON-key value storage means 220.

After the velocity value is read out as described above, the flow advances to step S311, in which a tone generation process at the time of re-triggering is executed using the read velocity value. In this manner, by executing the tone generation process, legato play using the solo function can be performed upon the OFF event with a velocity value that does not cause an unnatural feeling in the flow of play.

On the other hand, as a result of the judgment in step S306, if the keyboard event is an ON event, the flow advances from step S306 to step S312, in which a priority key selection process in the ON event is executed. After completion of this process, the flow advances to step S313, in which it is judged whether or not the ON key is the priority key. If the key corresponding to the above ON event is not the priority key, the flow advances to step S304 to repeat the aforementioned processes.

On the other hand, as a result of the judgment in step S313, if the above ON key is the priority key, the flow advances to step S314, in which a tone generation process upon the key ON event is executed. This tone generation process is executed using the velocity value stored in the above first-ON-key value storage means 220.

After completion of the tone generation process upon the key ON event in the above step S314, the flow then advances to step S315, in which it is judged whether or not the above ON key is the first key. As a result of this judgment, if it is not the first key, the flow advances to step S304. On the other hand, if it is the first key, the velocity value corresponding to the above ON key is kept in the first-ON-key value storage means 220.

Like the first embodiment, FIG. 3 shows the construction of a principal part of the electronic musical instrument of this embodiment. This electronic musical instrument comprises a keyboard 11, an operation panel 12, a display device 13, a key ON velocity detection circuit 14, etc. Also, the circuit section of the electronic musical instrument comprises a microcomputer made up from a CPU 21, a ROM 20, and a RAM 19 connected to one another through a bus 18. The above CPU 21 detects operation information on the keyboard 11 from a key switch circuit 15 connected to the keyboard 11, and detects operation information on a panel switch from a panel switch circuit 16 connected to the operation panel 12.

The operation panel 12 is provided with ten-key switches 12*a*, and select buttons 12*b* for selecting modes such as rhythm accompaniment, auto-chord play, ad-lib phrase play, etc. A type of rhythm or instrument selected by operating the operation panel 12, is displayed on the basis of display data given from the CPU 21 to the display device 13 via a display drive circuit 17.

The CPU 21 sends note information corresponding to keyboard operation, and parameter information on rhythm, tone color, etc., corresponding to panel switch operation, to the tone generation circuit 22. The tone generation circuit 22 reads out PCM sound source data from a waveform memory in the ROM 20 on the basis of these pieces of information, processes the amplitude and the envelope, and outputs them to a D/A converter 23. A tone signal that has been digital/analogue-converted by the D/A converter 23, is given to a loudspeaker 25 via an amplifier 24.

A program of a computer that comprises the RAM 19, the ROM 20, and the CPU 21, implements the ON-event processing means 212, the OFF-event processing means 213, the tone generation processing means 214, etc., of this embodiment.

In the electronic musical instrument of this embodiment, as described above, using the detection means detecting the velocity value of the ON key upon an ON event, and, when the ON key detected by the above detection means is the first ON key in the state that all keys had been OFF, the velocity value corresponding to the ON key, the volume upon tone generation of the tone corresponding to the key selected as the priority key, is controlled. Hence, the tone can be generated with a velocity value that causes a less unnatural feeling in the flow of play. Thus satisfactory legato play using the solo function can be performed.

The present invention can apply to a system made up from two or more devices, or an apparatus consisting of a single device.

Besides, the present invention also includes implementation in which, in order to make various devices operate so as to realize the functions of the above-described embodiment, to an apparatus connected to the above various devices or a computer in a system, a program code of software for realizing the functions of the above embodiment is supplied, and the above devices are made to operate in accordance with a program stored in a computer (CPU or MPU) in the system or apparatus.

Also, in this case, the program code of the above software itself realizes the functions of the above-described embodiment. The program code itself, and means for supplying the program code to the computer, e.g., a storage medium storing the above program code, constitute the present invention. As the storage medium storing the program code, usable are, e.g., a floppy disk, a hard disk, an optical disk, an optical magnetic disk, a CD-ROM, a magnetic tape, a nonvolatile memory card, a ROM, etc.

Also, in case that not only the explained functions in the above-described embodiment are realized by a computer executing a supplied program code, but also the functions shown in the above-described embodiment are realized by the program code cooperating with the OS (operating system) operating in the computer, or another application software or the like, that program code is included in the embodiment of the present invention.

Further, in case that the supplied program code is stored in a memory provided in a function extension board of the computer or a function extension unit connected to the computer, then the CPU or the like provided in the function extension board or the function extension unit executes part or all of the actual processes on the basis of instructions by the program code, and the functions of the above-described embodiment are realized by the processes. This is included in the present invention.

The above embodiments merely exemplify concreteness of implementation of the present invention, and the technical scope of the present invention must not be limited by those. That is, the present invention can be practiced in various forms without departing from its technical scope or its principal features.

What is claimed is:

1. An electronic musical instrument having a single-tone priority function comprising:

touch detection value storage means for detecting and storing the touch of a depressed key;

priority key selection means for selecting the first priority key out of the keys that were being depressed when a key, the tone of which has been generated, is released;

tone generation means for generating the tone corresponding to the first priority key selected by said priority key selection means;

tone volume computation means for computing the volume of a tone to be generated by said tone generation means, on the basis of said detected touch detection values; and tone generation control means for controlling generation of a tone with the volume computed by said tone volume computation means.

2. An electronic musical instrument according to claim 1, wherein said tone volume computation means computes the volume of the tone to be generated by said tone generation means, on the basis of said detected touch detection values.

3. An electronic musical instrument according to claim 1, wherein said touch detection value storage means detects and stores the touch of the first depressed key in the state that all keys had been released;

said tone volume computation means computes the tone volume corresponding to the touch detection value of said first depressed key stored in said touch detection value storage means; and said tone generation control means controls generation of a tone with the volume computed by said tone volume computation means.

4. An electronic musical instrument according to claim 2, wherein said tone volume computation means is generated in said tone generation means on the basis of the touch detection value in relation to the priority key stored in said touch detection value storage means, and the touch detection value in relation to the latest key.

5. An electronic musical instrument according to claim 4 wherein said tone volume computation means computes said tone generation volume with the average value of the latest touch detection value and the touch detection value in relation to the priority key stored in said touch detection value storage means.

6. An electronic musical instrument according to claim 5, wherein said tone generation control means controls generation of a tone with the volume computed by said tone volume computation means in response to a key release.

7. An electronic musical instrument according to claim 5, wherein said tone generation control means controls generation of a tone with the volume computed by said tone volume computation means in response to a release of a key, and controls to generate a tone with the volume corresponding to the touch detection value stored in said touch detection value storage means in response to a key depression.

8. An electronic musical instrument according to claim 4 wherein said tone volume computation means computes said tone generation volume with a weighted average value of the latest touch detection value and the touch detection value in relation to the priority key stored in said touch detection value storage means.

9. An electronic musical instrument according to claim 8, wherein said tone generation control means controls generation of a tone with the volume computed by said tone volume computation means in response to a key release.

10. An electronic musical instrument according to claim 8, wherein said tone generation control means controls to generate a tone with the volume computed by said tone volume computation means in response to a key release, and controls to generate a tone with the volume corresponding to the touch detection value stored in said touch detection value storage means in response to a key depression.

11. An electronic musical instrument according to claim 4 wherein said tone volume computation means does not use a touch detection value larger than a predetermined value, as data for computing said tone generation volume.

12. An electronic musical instrument according to claim 4, further comprising a keyboard including keys.

13. A tone generation control method in an electronic musical instrument having a single-tone priority function comprising:

a storage process of detecting the touch of a depressed key and storing it in touch detection value storage means;

a priority key selection process of selecting the first priority key out of the keys that were being depressed when a key, the tone of which has been generated, is released;

a tone generation process of generating a tone corresponding to said first priority key selected by said priority key selection process;

a tone volume computation process of computing the volume of a tone to be generated by said tone generation process, on the basis of a touch detection value stored in said touch detection value storage means; and a tone generation control process of controlling generation of a tone with the volume computed by said tone volume computation process.

14. A tone generation control method according to claim 13, wherein said tone volume computation process computes the volume of the tone to be generated by said tone generation process, on the basis of said detected touch detection values.

15. A tone generation control method according to claim 13, wherein said storage process detects and stores the touch of the first depressed key in the state that all keys had been released;

said tone volume computation process computes the tone volume corresponding to the touch detection value of said first depressed key stored in said touch detection value storage means; and said tone generation control process controls generation of a tone with the volume computed by said tone volume computation process.

16. A computer-readable recording medium that records a program for implementing a tone generation control having a single-tone priority function, said medium recording a program for causing a computer to execute:

a storage procedure for detecting the touch of a depressed key and storing it in touch detection value storage means;

a priority key selection procedure for selecting the first priority key out of the keys that were being depressed when a key, the tone of which has been generated, is released;

a tone generation procedure for generating the tone corresponding to the first priority key selected by said priority key selection procedure;

a tone volume computation procedure for computing the volume of a tone to be generated by said tone generation procedure, on the basis of a touch detection value stored in said touch detection value storage means; and a tone generation control procedure for controlling generation of a tone with the volume computed by said tone volume computation procedure.

17. A recording medium according to claim 16, wherein said tone volume computation procedure computes the volume of the tone to be generated by said tone generation procedure, on the basis of said detected touch detection values.

18. A recording medium according to claim 16, wherein said storage procedure detects and stores the touch of the first depressed key in the state that all keys had been released;

said tone volume computation procedure computes the tone volume corresponding to the touch detection value of said first depressed key stored in said touch detection value storage means; and said tone generation control procedure controls generation of a tone with the volume computed by said tone volume computation procedure.

* * * * *